US005080023A

United States Patent [19]

Miura et al.

[11] Patent Number: 5,080,023

[45] Date of Patent: Jan. 14, 1992

[54] PALLET HAVING PROTRUDING PORTION MEMBER

[75] Inventors: Toshihiko Miura; Ryohei Inaba, both of Kawasaki, Japan

[73] Assignee: Canon Kabushiki Kaisha, Tokyo, Japan

[21] Appl. No.: 585,628

[22] Filed: Sep. 20, 1990

[30] Foreign Application Priority Data

Sep. 28, 1989 [JP] Japan ..... 1-112757[U]
Jul. 30, 1990 [JP] Japan ..... 2-199177

[51] Int. Cl.[5] ..... B65D 19/44
[52] U.S. Cl. ..... 108/55.3; 108/51.1
[58] Field of Search ..... 108/55.1, 55.3, 55.5, 108/56.1, 56.3, 51.1, 901, 902, 60

[56] References Cited

U.S. PATENT DOCUMENTS 3,580,190 5/1971 Fowler ..... 108/51.1
4,290,370 9/1981 Gallagher et al. ..... 108/51.1 X
4,579,489 4/1986 Sarantitis ..... 108/56.3 X
4,580,680 4/1986 Wind ..... 108/55.3 X
4,693,370 9/1987 Aceti ..... 108/55.1 X
4,747,495 5/1988 Hoss ..... 108/55.3 X
4,774,892 10/1988 Ballard et al. ..... 108/55.1 X
4,930,632 6/1990 Eckert et al. ..... 108/55.1 X

FOREIGN PATENT DOCUMENTS 2159650 6/1972 Fed. Rep. of Germany ..... 108/55.3
2216053 7/1973 Fed. Rep. of Germany ..... 108/55.3
7713437 12/1978 France ..... 108/51.1

*Primary Examiner*—JosAUC/e/ V. Chen
*Attorney, Agent, or Firm*—Fitzpatrick, Cella, Harper & Scinto

[57] ABSTRACT

A pallet for supplying component parts has a flat bottom plate serving as a recess for accommodating plural parts and plural partition members protruding upwards from the bottom plate for separating the parts accommodated in the recess in mutually independent manner, wherein the partition members have a polygonal shape in plan view and are arranged at a constant pitch.

2 Claims, 6 Drawing Sheets

PALLET HAVING PROTRUDING PORTION MEMBER

BACKGROUND OF THE INVENTION

1. Field of the Invention

The present invention relates to a part supplying pallet used for supplying plural parts.

2. Related Background Art

There is conventionally used a part supplying pallet supporting plural component parts, for continuously supplying an automatic assembling apparatus with plural component parts. FIG. 7 shows such conventional part supplying pallet a, which is provided with plural recesses c on the upper face thereof, for accommodating component parts b of a predetermined shape in a predetermined orientation.

Thus, in such conventional part supplying pallet, the orientation of each component part accommodated in said pallet has to be exactly defined, in the supply of component parts for example to an automated assembling machine, for simplifying the control of an assembling robot. For this reason each recess c is defined slightly larger than the external shape of the part b, which cannot therefore move freely in said recess once the part is accommodated therein.

Therefore the insertion of the part in each recess is a rather cumbersome operation. Therefore, insertion of plural parts b with a predetermined orientation into plural recesses c cannot be achieved in a collective manner but has to be made one at a time in repeated operations, so that the efficiency of work is extremely low.

In consideration of the foregoing, there is being developed a technology for taking the image of a pallet with a camera, discriminating the orientation of each part b in the pallet by means of an image recognition apparatus, and adequately picking each part b up by driving a handling device according to the result of said discrimination. Use of such part pickup apparatus utilizing a camera eliminates the necessity for precise definition of orientation of the parts as shown in FIG. 7 and considerably increases the freedom in the insertion of the parts b into the pallet a.

However, there has not been proposed a part supplying pallet optimum for a part pickup apparatus utilizing a camera, and an improvement on the pallet has been longed for.

SUMMARY OF THE INVENTION

In consideration of the foregoing, an object of the present invention is to provide a part supplying pallet optimum for a manual part pickup operation and for an automatic part pickup operation utilizing a camera.

Another object of the present invention is to provide a pallet capable of accommodating various articles, wherein partition members for accommodating articles are made detachable to render the areas defined by said partition members variable.

BRIEF DESCRIPTION OF THE DRAWINGS

FIGS. 8 to 11 illustrate an application, wherein FIG. 8 is an external perspective view of a pallet;

FIG. 9 is a plan view of a pallet member 1;

FIG. 10 is a plan view of a pallet member 1; and

FIG. 11 is an exploded perspective view of an article supplying pallet.

DETAILED DESCRIPTION OF THE PREFERRED EMBODIMENTS

In the following there will be explained in detail the structure of an embodiment of the part supplying pallet of the present invention, with reference to FIGS. 1 to 6B.

Figure 1:
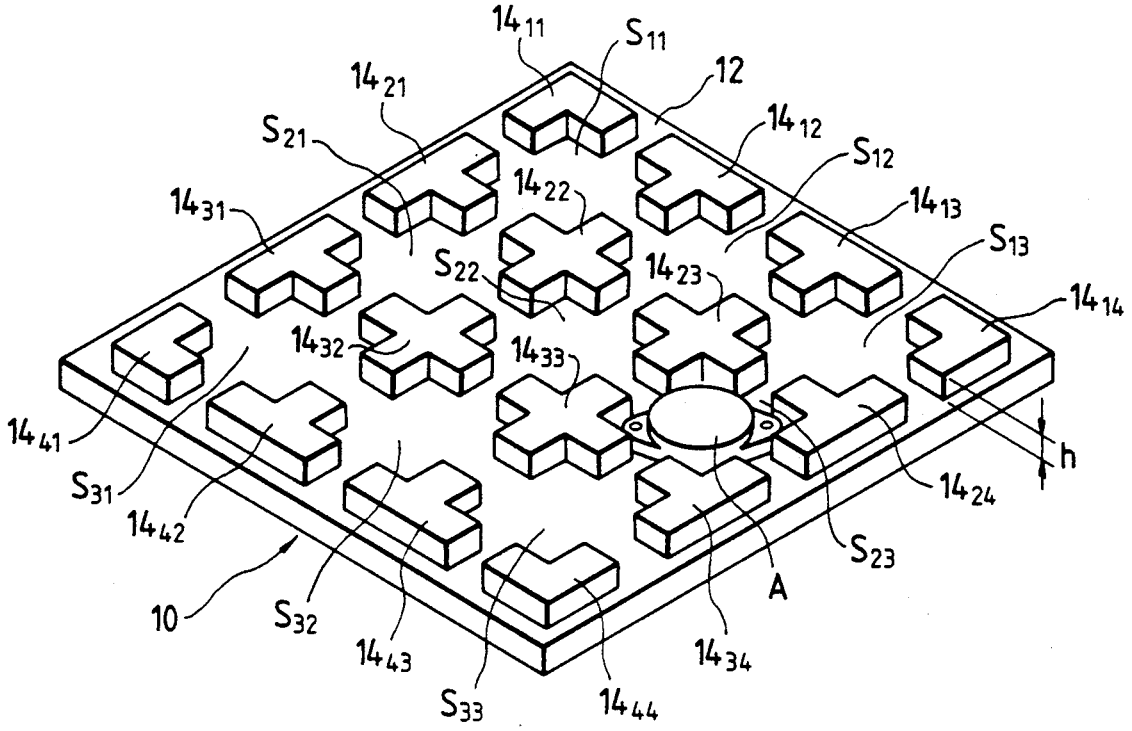
FIG. 1 is a perspective view of an embodiment of the part holding pallet of the present invention.

As shown in FIG. 1, the part supplying pallet 10 of the present embodiment is provided with a plate-shaped pallet member 12 of a plastic material, on which plural partition members 14, for defining storage spaces S for respectively storing plural parts A, are provided with a constant pitch over the substantially entire area. Said partition members 14 integrally protrude with a height h from the upper face of the pallet member 12.

In the present embodiment there are provided sixteen partition members 14 arranged in a $4\times4$ matrix, and a storage space S for accommodating a part A in independent state is defined by an area surrounded by partition members 14 positioned at the mutually adjacent four corners. Also said partition members 14 are mutually independently provided with a gap g between the adjacent ones, wherein said gap g is selected slightly larger than the average width of a finger.

There are provided three kinds in said partition members 14. In four corners of the pallet member 12 there are provided four partition members $\mathbf{14}_{11}$, $\mathbf{14}_{14}$, $\mathbf{14}_{41}$ and $\mathbf{14}_{44}$ of a first kind; along the sides of the pallet member 12, excluding the corners, there are provided eight partition members $\mathbf{14}_{12}$, $\mathbf{14}_{13}$, $\mathbf{14}_{21}$, $\mathbf{14}_{24}$, $\mathbf{14}_{31}$, $\mathbf{14}_{34}$, $\mathbf{14}_{42}$ and $\mathbf{14}_{43}$ of a second kind; and in the central area of the pallet member 12 excluding the perimeter area there are provided four partition members $\mathbf{14}_{22}$, $\mathbf{14}_{23}$, $\mathbf{14}_{32}$ and $\mathbf{14}_{33}$ of a third kind.

In the present embodiment, the partition members $\mathbf{14}_{22}$, $\mathbf{14}_{23}$, $\mathbf{14}_{32}$ and $\mathbf{14}_{33}$ of the third kind are substantially cross-shaped in plan view, extending in four directions with a width W. Each of the partition members of the second kind, positioned along the edges but excluding the four corners, has a shape obtained by bisecting the partition member of the third kind at the center, namely a substantially T-shape in plan view. Also each of the partition members of the first kind, positioned at the four corners, has a shape obtained by cutting the partition member of the third kind equally into four, namely a substantially L-shape in the plan view.

Each of the above-mentioned storage spaces S has a substantially rectangular shape, and nine storage spaces are defined by 16 partition members 14. For example a storage space $S_{11}$ at the farthest side in FIG. 1 is defined by an area surrounded by the partition members $\mathbf{14}_{11}$, $\mathbf{14}_{12}$, $\mathbf{14}_{21}$ and $\mathbf{14}_{22}$, while a storage space $S_{33}$ at the nearest side in FIG. 1 is defined by an area surrounded by the partition members $\mathbf{14}_{33}$, $\mathbf{14}_{34}$, $\mathbf{14}_{43}$ and $\mathbf{14}_{44}$.

At each storage space S, and in the centers of four sides defining said storage space, there are formed four slits S( of a width g communicating with the neighboring storage spaces S. The length of each slit Sl corresponds to the width W of the above-explained partition member 14.

Figure 2:
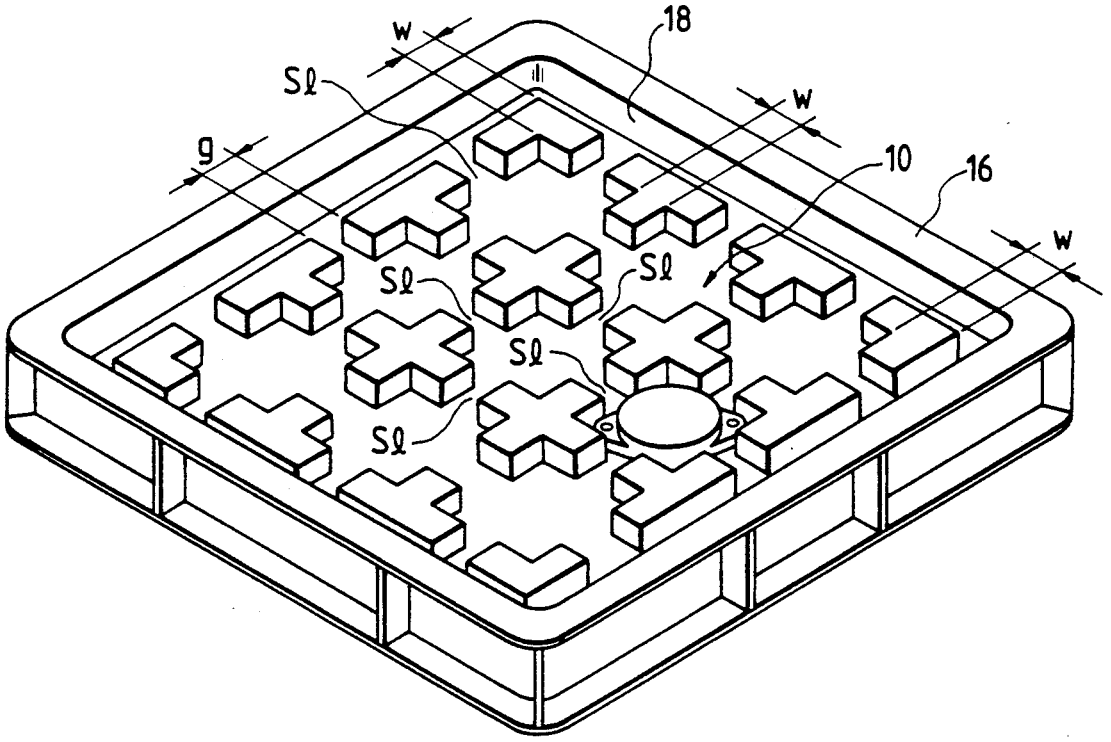
FIG. 2 is a perspective view of the pallet shown in FIG. 1, in a state housed in a magazine.

The above-explained pallet 10 is transported or handled in a state housed in a magazine 16 constituting an outer case, as shown in FIG. 2. Said magazine 16 is provided, in the upper face thereof, with a recess 18 capable of completely accommodating said pallet 10, and the depth d of said recess 18 is selected larger than the sum of the thickness of the pallet member 12 and the height h of the partition members 14.

Because of the above-explained structure of the part supplying pallet 10, the size of the parts A which can be supplied by said pallet 10 can be arbitrarily selected within a range from an upper limit defined by the size of the storage space S to a lower limit defined by the width g of the slits Sl. Consequently the loading operation of the parts A into the pallet 10 has an extremely large freedom either in manual operation or in automated operation, and the parts A can be respectively loaded in the storage spaces S sufficiently securely even with a considerably rough precision of operation. It is therefore rendered possible to improve the efficiency of loading operation of the parts A and to reduce the time required for such loading operation.

Figure 3:
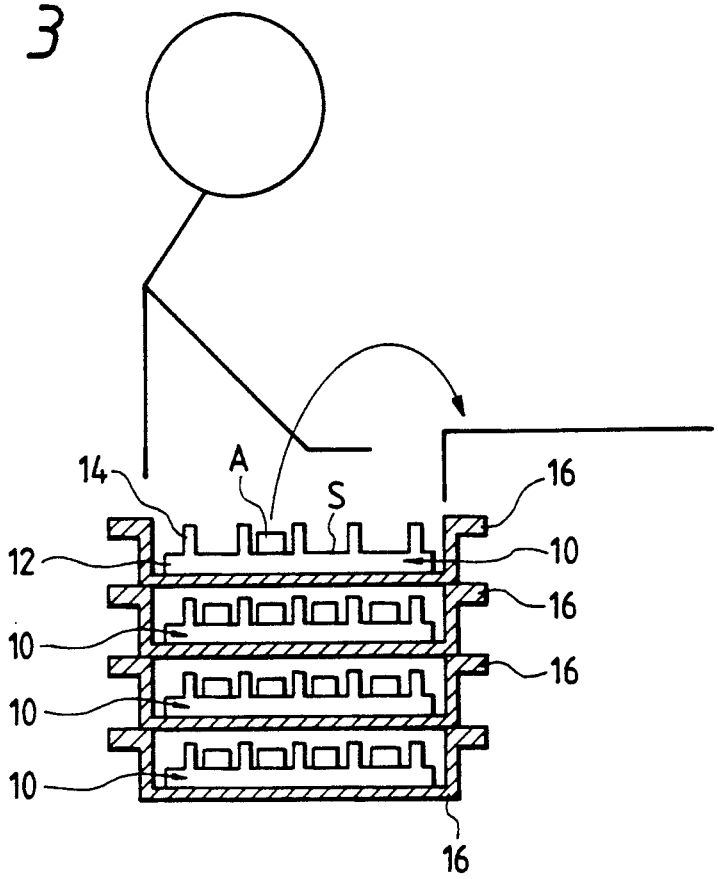
FIG. 3 is a schematic view of a state of a manual pickup operation of parts from the pallet.

Also in case of manually picking up a part A of a size occupying the substantially entire storage S, from the pallet 10, as shown in FIG. 3, the part A can be securely grasped by inserting two fingers in the slits Sl formed in the mutually opposite two sides of each storage space S.

Figure 4:
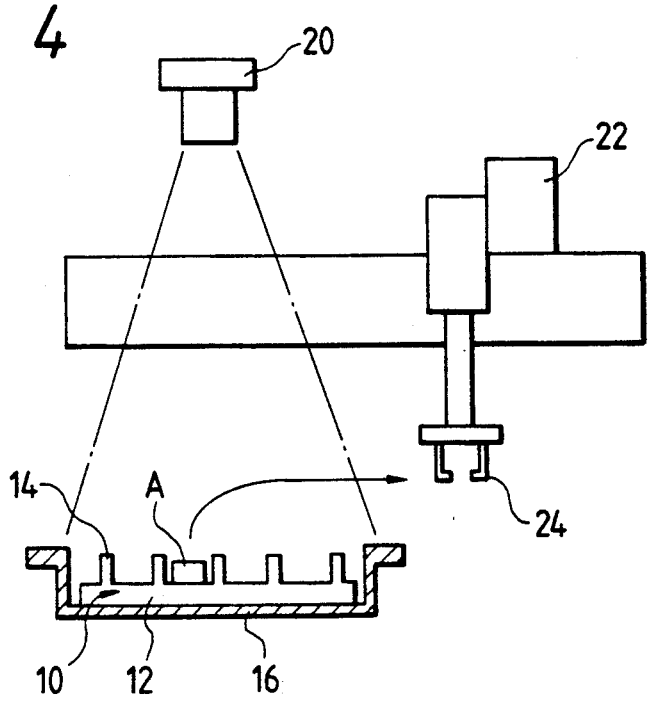
FIG. 4 is a schematic view of an automatic pickup operation of parts from the pallet.
Figure 5:
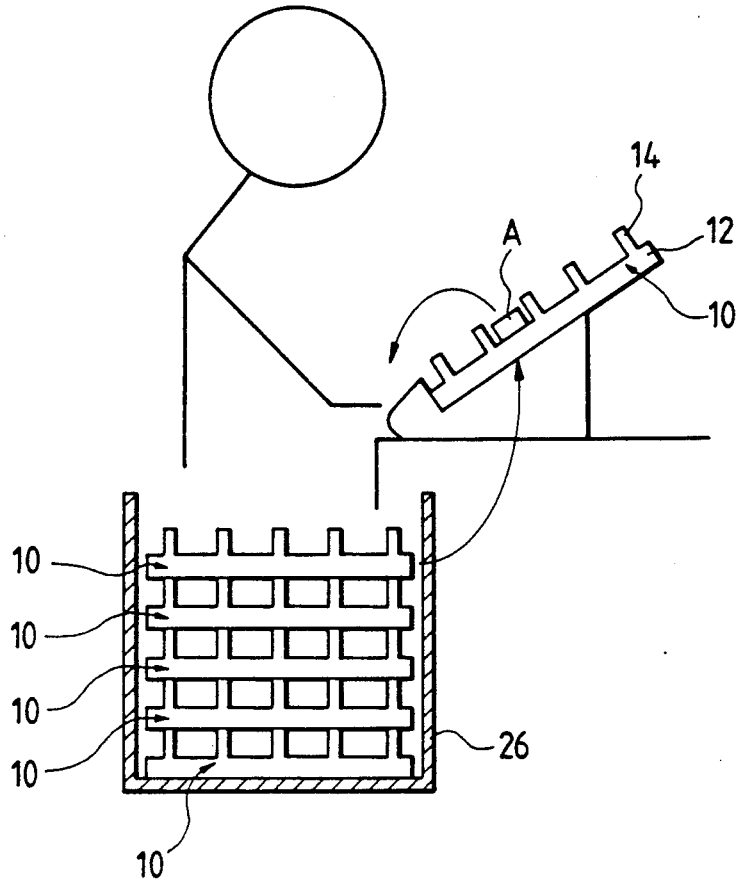
FIG. 5 is a schematic view of a manual pickup operation of parts from the pallet in a mode different from that in FIG. 3.
Figure 6A:
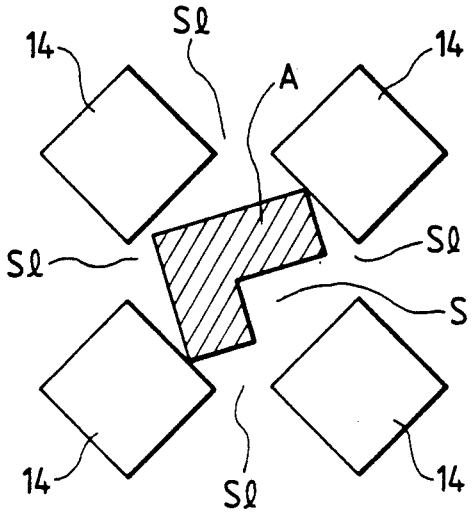
FIGS. 6A and 6B are plan views showing different variations of partition members.
Figure 6B:
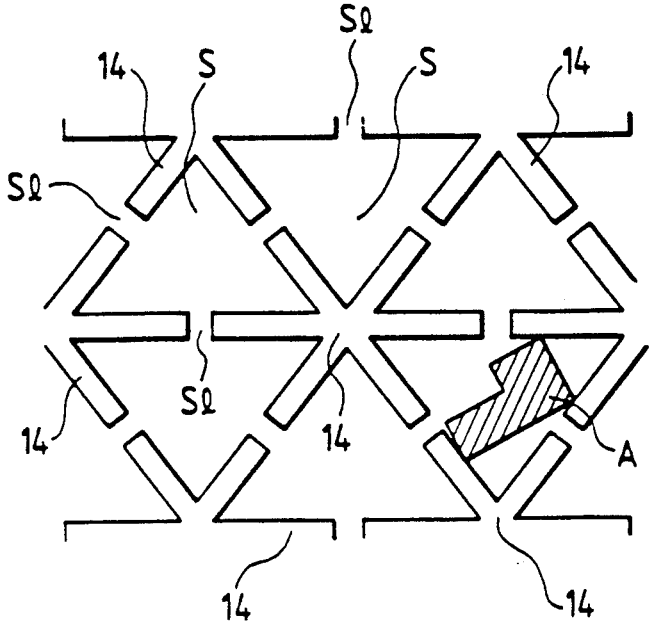
FIG. 6B PRIOR ART
Figure 7:
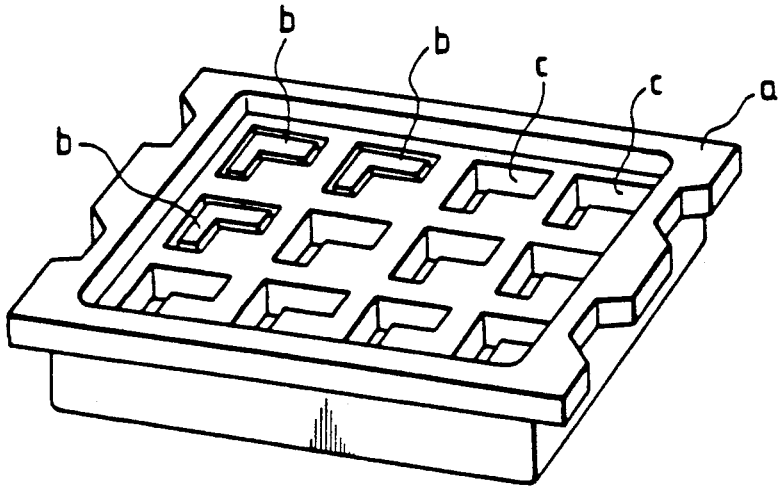
FIG. 7 PRIOR ART
FIG. 7 is a perspective view of a conventional pallet.

Also in case of an automatic pickup operation of the part A from the pallet 10 as shown in FIG. 4, a position recognizing camera 20 observes the state of loading of the parts A in the storage spaces S of the pallet 10, and the position and orientation of loading are recognized by an unrepresented image processing apparatus. Then a pickup robot 22 is activated according to the result of said recognition, and holding fingers 24 of said robot 22 are moved according to the recognized position and orientation of the part A, thereby picking said part A up from the corresponding storage space S.

Even when the part A is positioned at a corner part of the storage space S, thus leaving no space for the finger 24 between said part A and the partition member 14, said finger 24 may be inserted into the slit Sl as in the case of manual pickup. Thus the finger 24 can be securely positioned at a side of the part A, so that the pickup operation with the fingers 24 can be conducted without failure.

As explained in the foregoing, the part supplying pallet 10 of the present embodiment is suitable not only for the loading and pickup of the parts A by manual operation but also for the automatic operation with an assembling robot, and is industrially valuable.

The present invention is not limited to the foregoing embodiment but is naturally subject to various modifications within the scope and spirit of the appended claims.

For example, in the foregoing description, the manual pickup of the parts is assumed to be conducted while the pallet 10 is housed in the magazine 16 as shown in FIG. 3, but such operation may be conducted while the pallet 10 is taken out. It is also possible to store plural pallets 10 in a returnable container 26 and to take out said pallets 10 one by one from said container.

Also in the above-explained embodiment, the partition members are of a cross shape and other shapes obtained by dividing said cross shape. However the present invention is not limited to such embodiment, and the partition members may have various other polygonal shapes, such as a rectangular shape or a star shape with six legs, as variations shown in FIGS. 6A and 6B.

As explained in the foregoing, the part supplying pallet of the present invention is provided with a pallet member having a flat bottom part and recesses for accommodating plural parts therein, and plural partition members protruding upwards from said bottom part for mutually independently separating the parts accommodated in said recesses, wherein said partition members are provided with a polygonal shape in plan view and are arranged at a constant pitch.

Also the part supplying pallet of the present invention is characterized by a fact that each partition member has a substantially cross-like shape and a storage space in which a part is stored in independent state is defined by an area surrounded by partition members positioned at mutually adjacent four corners.

The part supplying pallet of the present invention is further characterized by a fact that the partition members, positioned at the edge portions of the pallet, excluding the corner portions thereof, have a shape obtained by bisecting the shape of first-mentioned partition members.

The part supplying pallet of the present invention is further characterized by a fact that the partition members, positioned at the corner portions of the pallet, have a shape obtained by dividing, into four, the shape of the first-mentioned partition members.

Consequently the present invention provides a part supplying pallet optimum for a manual part pickup operation and for an automatic part pick-up operation utilizing a camera.

In the following there will be explained an applied embodiment of the present invention, with reference to FIGS. 8 to 11.

The present embodiment relates to a part supplying pallet for supporting, on a support face, plural articles in mutually separate manner by means of partition members, wherein said partition members are detachably mounted on said support face and are positioned according to the external dimension of said articles.

Figure 8:
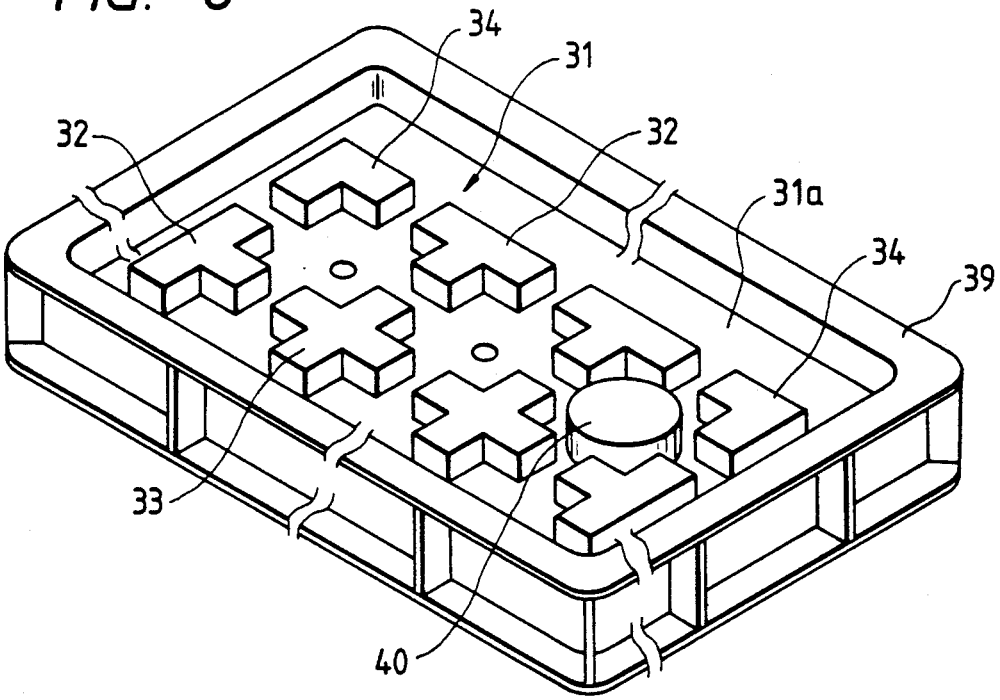

FIG. 8 is an external perspective view of the pallet of the present embodiment. An external container 39, so-called returnable container, is composed for example of a resinous material, and is integral with an external periphery portion for reinforcing and holding, and a bottom portion not shown in the drawing, thus being capable of holding a pallet member 31 therein. Said pallet member 31 is provided with a support plate 31*a* for supporting articles 40, and partition members 32, 33, 34 for maintaining said articles 40 at a substantially uniform distance, with a certain clearance with respect to the external dimension of the articles 40.

For example, in a manufacturing operation with small lot sizes, the external dimension of the articles 40 may often vary, so that the partition members 32, 33, 34 have to be provided at optimum positions according to the sizes of said articles. The pallet member 31 may be integrally formed with the outer container 39.

Figure 9:
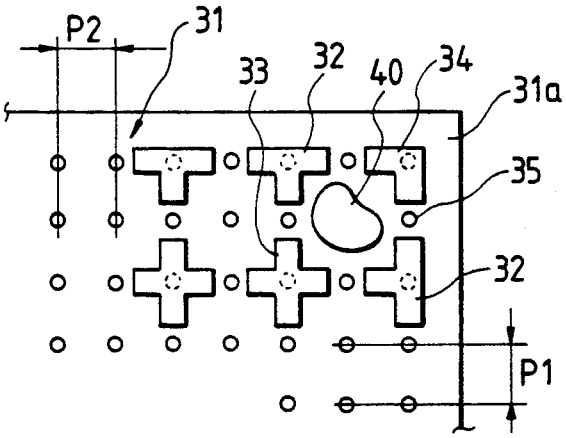

FIG. 9 is a plan view of the pallet member 31 shown in FIG. 8, wherein the support plate 31*a* of said pallet member 31 is provided with plural holes 35 in a matrix arrangement with pitches P1, P2 in the vertical and horizontal directions. Said pitches P1, P2 need not be mutually equal, but either may be a multiple of the other.

On said support plate 31*a* there are provided first T-shaped partition members at the edge portions, second L-shaped partition members at the corner portions, and third cross-shaped partition members in the central area, whereby the articles 40 of an approximately circular external shape are supported in a mutually separate manner.

Figure 10:
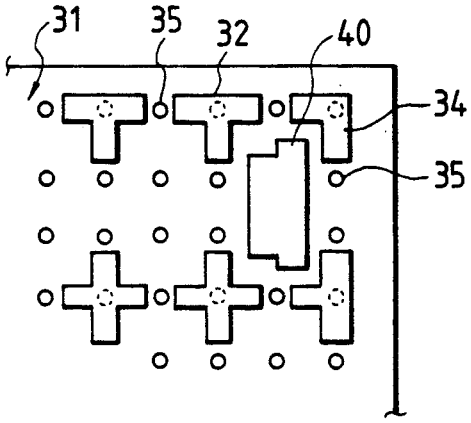

FIG. 10 is also a plan view of the pallet member 31 shown in FIG. 8, wherein the first T-shaped partition member is provided in every other hole 35 in the horizontal direction of the support plate 31*a* while it is provided in every three holes 35 in the vertical direction. The second L-shaped partition members are provided at the four corners of the support plate 31*a*. In the internal area of the support plate 31*a*, the third cross-shaped partition member is provided in every other hole in the horizontal direction and every three holes in the vertical direction. Thus articles 40 of an approximately rectangular external shape can be supported on the support plate 31*a* in a mutually separate manner.

Figure 11:
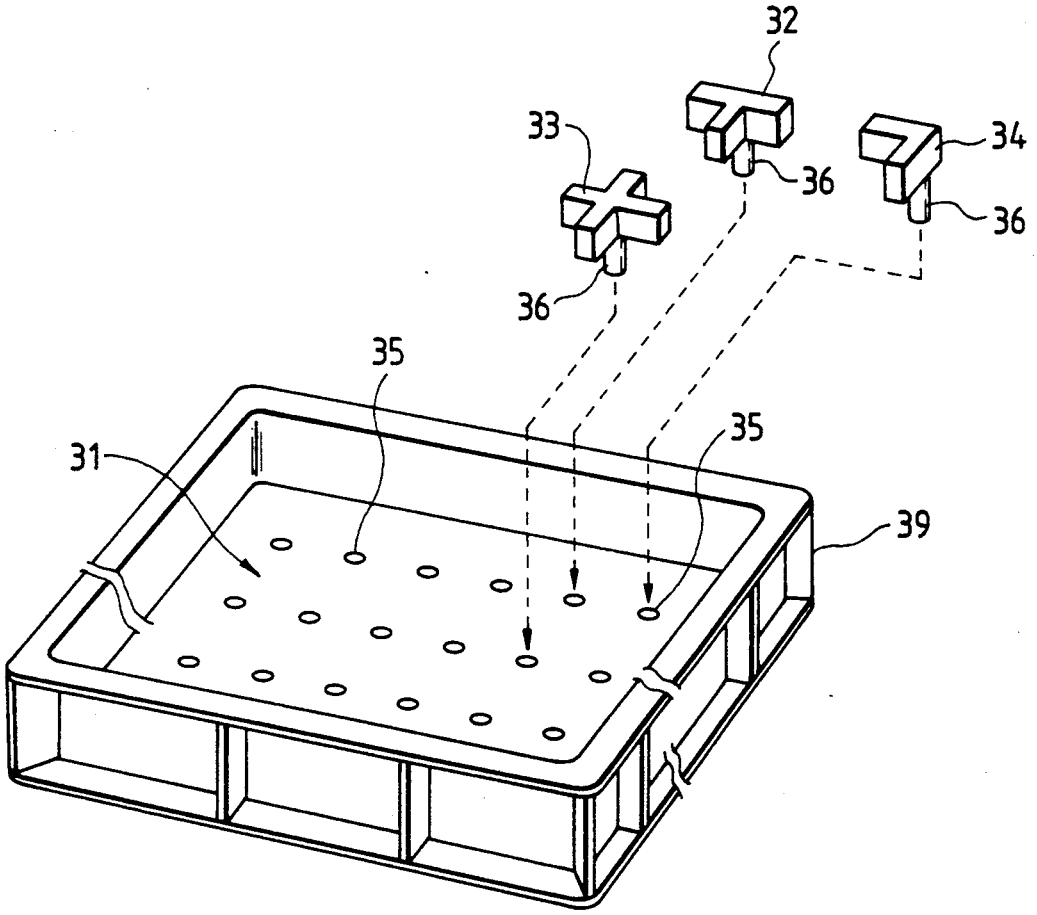

FIG. 11 is an exploded perspective view of the part supplying pallet, wherein components already explained before are represented by same numbers as in the foregoing description, and will not be explained further. At the bottom of the first partition member 32, second partition member 34 or third partition member 33 there is provided a fixing pin, in a broken-lined position in FIG. 9 or 10, which can be inserted into the hole 35. The external dimension of said fixing pin 36 is made slightly smaller than the internal diameter of said hole 35, and is provided with an unrepresented key on the external periphery, whereby the partition member can be fixed in a state shown in FIG. 9 or 10 once the pin 36 is inserted into the hole 35.

The setting of such partition members may be conducted manually, or by a robot.

As explained in the foregoing, the present invention provides a part supplying pallet capable of reducing the time and cost required for the preparation of a pallet corresponding to the external dimension of the articles to be supported by the pallet.

What is claimed is:

1. A part supplying pallet comprising:

a pallet member having a flat bottom plate forming a recess for accommodating plural parts therein; and a plurality of partition members protruding upwardly from said bottom plate for separating the parts accommodated in said recess in a mutually independent manner, wherein partition members centrally disposed on said flat bottom plate have a polygonal shape in plan view and are arranged with a substantially uniform pitch, and partition members disposed at edge portions of said flat bottom plate, excluding corner portions, have a shape obtained by bisecting the shape of said centrally disposed partition members.

2. A part supplying pallet comprising:

a pallet member having a flat bottom plate forming a recess for accommodating plural parts therein; and a plurality of partition members protruding upwardly from said bottom plate for separating the parts accommodated in said recess in a mutually independent manner, wherein partition members centrally disposed on said flat bottom plate have a polygonal shape in plan view and are arranged with a substantially uniform pitch, and partition members disposed at corners of said flat bottom plate have a shape obtained by dividing, into $\frac{1}{4}$, the shape of said centrally disposed partition members.

* * * * *

UNITED STATES PATENT AND TRADEMARK OFFICE

CERTIFICATE OF CORRECTION

PATENT NO. : 5,080,023

DATED : January 14, 1992

INVENTOR(S) : Toshihiko Miura, et al.

It is certified that error appears in the above-identified patent and that said Letters Patent is hereby corrected as shown below:

On the title page, Item [54] and in Column 1 line 3:

"MEMBER" should read --MEMBERS--.

[56] REFERENCES CITED:

Primary Examiner, JosAUC/e/ V. Chen" should read --Jose V. Chen--.

COLUMN 3:

Line 3, "slits S(" should read --Sl--.
Line 30, "storage S," should read --storage spaces S,--.

Signed and Sealed this

Twenty-first Day of September, 1993

Bruce Lehman

Attest:

BRUCE LEHMAN

Attesting Officer

Commissioner of Patents and Trademarks